US006594997B2

(12) United States Patent
Romanelli

(10) Patent No.: US 6,594,997 B2
(45) **Date of Patent: *Jul. 22, 2003**

(54) VAPOR ENGINES UTILIZING CLOSED LOOP FLUOROCARBON CIRCUIT FOR POWER GENERATION

(76) Inventor: Pat Romanelli, 224 Brook St., Harrington Park, NJ (US) 07640

( * ) Notice: Subject to any disclaimer, the term of this patent is extended or adjusted under 35 U.S.C. 154(b) by 45 days.

This patent is subject to a terminal disclaimer.

(21) Appl. No.: 10/041,841

(22) Filed: Jan. 7, 2002

(65) Prior Publication Data

US 2003/0070431 A1 Apr. 17, 2003

Related U.S. Application Data

(63) Continuation-in-part of application No. 09/974,543, filed on Oct. 9, 2001, now Pat. No. 6,397,600.

(51) Int. Cl.[7] ..... F01K 25/08
(52) U.S. Cl. ..... 60/651; 60/671
(58) Field of Search ..... 60/39.6, 370, 651, 60/671

(56) References Cited

U.S. PATENT DOCUMENTS

| | | | | | |
|---|---|---|---|---|---|
| 3,651,641 | A | * | 3/1972 | Ginter | 60/39.26 |
| 3,765,180 | A | * | 10/1973 | Brown | 60/370 |
| 3,938,334 | A | | 2/1976 | Matthews | 60/641 |
| 4,009,082 | A | | 2/1977 | Smith, Jr. | 203/11 |
| 4,018,050 | A | * | 4/1977 | Murphy | 60/370 |
| 4,086,772 | A | | 5/1978 | Williams | 60/651 |
| 4,170,116 | A | | 10/1979 | Williams | 62/116 |
| 4,171,618 | A | * | 10/1979 | Aegerter | 60/716 |
| 4,270,350 | A | | 6/1981 | Chevalier | 60/516 |
| 4,276,748 | A | | 7/1981 | Wahl, III et al. | 60/641 |
| 4,321,799 | A | | 3/1982 | Pierotti et al. | 62/112 |
| 4,357,212 | A | | 11/1982 | Osterman et al. | 202/170 |

(List continued on next page.)

OTHER PUBLICATIONS

Allied Signal Chemicals, Genetron AZ–20 (R–410A) Product Brochure on Fluorocarbons pp. 1–12 (1995).

Allied Signal Chemicals, Genetron Product Brochure on Fluorocarbons, pp. 1–12 (1995).

*Primary Examiner*—Hoang Nguyen
(74) *Attorney, Agent, or Firm*—Winston & Strawn

(57) ABSTRACT

A method and apparatus for efficiently generating mechanical or electrical energy. The method includes the steps of heating a vaporizable, first liquid heat transfer medium to generate a high pressure vapor; utilizing the high pressure vapor to provide mechanical energy and thereafter condensing the vapor to a liquid; and recycling the condensed liquid to the heating step for re-use as the first liquid heat transfer medium. The apparatus includes a closed loop heat transfer medium system having a first heat exchanger for heating a vaporizable, first liquid heat transfer medium to generate a high pressure vapor; a mechanical device which utilizes the high pressure vapor to provide mechanical energy; a condenser for condensing the vapor to a liquid; and piping for fluidly connecting the first heat exchanger, mechanical device and condenser, and for recycling the condensed liquid to the first heat exchanger for re-use. The first heat transfer medium is preferably maintained in a hermetically sealed circuit so that essentially no loss of heat transfer medium occurs during the heating and condensing steps, and is a fluorocarbon or fluorocarbon mixture that (a) generates a high pressure of at least 400 psi at a pressure generation temperature that is below the boiling point of water, (b) has a boiling point which is below the freezing point of water, and (c) has a critical temperature which is above that of the pressure generation temperature. Also disclosed are various apparatus and vapor engines that utilize the heat transfer medium and to generate electrical power or motive forces.

18 Claims, 6 Drawing Sheets

U.S. PATENT DOCUMENTS

| | | | | | |
|---|---|---|---|---|---|
| 4,372,126 | A | | 2/1983 | Sebald, deceased | 60/669 |
| 4,481,775 | A | | 11/1984 | Beveridge | 60/649 |
| 4,507,918 | A | * | 4/1985 | Holleyman | 60/370 |
| 4,698,973 | A | | 10/1987 | Johnston | 60/670 |
| 4,805,410 | A | | 2/1989 | Johnston | 60/671 |
| 4,920,750 | A | | 5/1990 | Iishiki et al. | 60/671 |
| 4,978,467 | A | | 12/1990 | Shankland et al. | 252/69 |
| 5,375,564 | A | * | 12/1994 | Gail | 123/44 C |
| 5,400,615 | A | | 3/1995 | Pearson | 62/277 |
| 5,403,504 | A | | 4/1995 | Bivens et al. | 252/67 |
| 5,775,107 | A | | 7/1998 | Sparkman | 60/641.8 |
| 6,176,102 | B1 | | 1/2001 | Novak | 62/612 |
| 6,397,600 | B1 | * | 6/2002 | Romanelli | 60/671 |

* cited by examiner

VAPOR ENGINES UTILIZING CLOSED LOOP FLUOROCARBON CIRCUIT FOR POWER GENERATION

CROSS-REFERENCE TO RELATED APPLICATIONS

This application is a continuation-in-part of application Ser. No. 09/974,543 filed Oct. 9, 2001, now U.S. Pat. No. 6,397,600.

TECHNICAL FIELD

The invention relates to the development of energy for the purpose of creating power that can be used in a variety of applications, including the generation of electric or motive power for land, marine or air transportation, and to devices and engines for using the same.

BACKGROUND

The present day forms of creating power are generally dependent upon the burning of fossil fuels to generate electric power. In doing so, a serious environmental problem is created in the form of air, water and land pollution. Also, in burning such fuels to create kinetic energy, thermal efficiencies are relatively inefficient due to the formation of incomplete combustion products. This results in exhaust pollution of these products, such as carbon monoxide, carbon dioxide, nitrous oxides and particulates.

Certain attempts have been made to create power without generating such pollutants. Williams U.S. Pat. Nos. 4,086,772 and 4,170,116 disclose a continuous method and closed cycle system for converting thermal energy into mechanical energy. This system comprises vaporizing means, including an energy conversion tube having a special nozzle section, for converting a liquid working fluid stream to a vapor stream. This vapor stream operates a turbine means wherein a portion of the energy of the vapor stream is converted to mechanical shaft work. This system also includes means for increasing the thermal and static energy content of the fluid stream, this means typically being pump means. The vapor fraction of that exits the turbine means passes through condensing means, such as a diffuser, to regenerate the working liquid stream. Finally, means are provided for recycling the condensed liquid stream back to the vaporizing means. The working fluid may be carbon dioxide, liquid nitrogen, or a fluorocarbon. Preferred fluorocarbons are difluoromonochloromethane, pentafluoromonochloroethane, difluorodichloromethane and mixtures and azeotropes thereof.

Johnston U.S. Pat. Nos. 4,805,410 and 4,698,973 disclose closed loop systems that recirculate a vaporizable working fluid between its liquid and vapor states in a thermodynamic working cycle. In this cycle, energy received from an external energy source is utilized to vaporize the fluid to a high pressure in a boiler unit. The resulting vapor is utilized in an energy utilizing device, such as a slidable piston which causes rotation of a crank shaft coupled to a flywheel to deliver mechanical output at a rotating shaft connected thereto. Thereafter, the vapor is condensed into a condensate at a relatively lower pressure in a condensing unit and then is returned to the boiler unit for repeating of the thermodynamic cycle. Also, the condensate flow between the condensing unit and boiler unit is collected in one of two holding tanks in selective pressure communication with the boiler unit. Preferred working fluids include water, Freon or ammonia. Also, thermal regeneration means may be included for providing regenerative heating of the working fluid.

While these prior art systems are somewhat suitable for their intended purpose, there remains a need for improvements in power generation, in particular for small, more efficient systems including engines for generating torque and power. This is now provided by the embodiments of the present invention disclosed herein.

SUMMARY OF THE INVENTION

The present invention relates to a method for efficiently generating mechanical energy which comprises heating a vaporizable, first liquid heat transfer medium to generate a high pressure vapor; utilizing the high pressure vapor to provide mechanical energy and thereafter condensing the vapor to a liquid; and recycling the condensed liquid to the heating step for re-use as the first liquid heat transfer medium. The first heat transfer medium is maintained in a hermetically sealed circuit so that essentially no loss of the heat transfer medium occurs during the heating and condensing steps.

Advantageously, the first liquid heat transfer medium comprises a fluorocarbon or fluorocarbon mixture that (a) generates a high pressure of at least 400 psi at a pressure generation temperature that is below the boiling point of water, (b) has a boiling point which is below the freezing point of water, and (c) has a critical temperature which is above that of the pressure generation temperature. Preferably, the first liquid heat transfer medium comprises a fluorocarbon mixture that (a) generates a high pressure of at least 500 psi at a pressure generation temperature that is below 190° F., (b) has a boiling point which is at least 10° F. below the freezing point of water, and (c) has a critical temperature which is above 150° F.

The heating step advantageously comprises heating a second liquid heat transfer medium which is different from the first heat transfer medium and utilizing the heated second heat transfer medium to heat and vaporize the first heat transfer medium. The second heat transfer medium is preferably heated to a temperature of less than 200° F. by nuclear energy, solar energy, electric energy, or combustion of fossil fuels, natural or synthetic gases, alcohol, or vegetable or plant material. The heated second medium is passed through heat exchanger tubes which are in contact with and heat the first medium.

The vapor utilizing step comprises passing the vapor through a turbine to rotate a shaft for generation of power or torque. The rotating shaft may be operatively associated with vehicle wheels to provide motion to the vehicle. When arranged in this manner, the vapor pressure passing through the turbine can be reversed to provide braking to the wheels and vehicle.

Alternatively, the vapor utilizing step may include utilizing the pressure of the vapor to operate one or a plurality of pistons in an engine to generate horsepower. The engine may be located on a boat or ship and is operatively associated with a propeller or blade to provide marine propulsion. Also, the vapor utilizing step may comprise passing the vapor through a turbine of an aircraft engine to provide flight propulsion.

The vapor may be condensed in an air cooled condenser, or in a heat exchanger where heat is recovered from the vapor and utilized elsewhere. If desired, the movement of the first heat transfer medium in the circuit can be assisted by pumping it from the vapor utilizing step to the condensing step. In addition, valving can be included to assist in movement of the medium.

The invention also relates to an apparatus for efficiently generating power or torque which comprises a closed loop heat transfer medium system comprising a first heat exchanger for heating a vaporizable, first liquid heat transfer medium to generate a high pressure vapor; a mechanical device which utilizes the high pressure vapor to provide mechanical energy; a condenser for condensing the vapor to a liquid; and piping for fluidly connecting the first heat exchanger, mechanical device and condenser, as well as for recycling the condensed liquid to the first heat exchanger for re-use.

The first heat exchanger has exchanger tubes that include therein a second liquid heat transfer medium which is different from the first heat transfer medium, and the apparatus further comprises a second heat exchanger for heating second heat transfer medium, wherein the heated second heat transfer medium is passed through the exchanger tubes of the first heat exchanger to heat and vaporize the first heat transfer medium. The second heat transfer medium is heated to a temperature of less than 200° F. by a heating device that is powered by nuclear energy, solar energy, electric energy, or combustion of fossil fuels, alcohol, or vegetable or plant material.

The first heat transfer medium is generally maintained in a hermetically sealed circuit so that essentially no loss of heat transfer medium occurs during the heating and condensing steps. Also, the mechanical device may be a turbine that rotates a shaft for generation of power or torque, or an engine that includes one or more pistons with the pressure of the vapor utilized to operate one or more of the pistons in the engine to generate horsepower. The engine may be located on a boat or ship and be operatively associated with a propeller or blade to provide marine propulsion. Alternatively, the mechanical device may be a turbine of an aircraft engine with the pressure of the vapor utilized to operate the turbine to provide flight propulsion.

The apparatus may further comprise a pump for directing the first beat transfer medium from the vapor utilizing to the condensing steps. Also, valving may be provided for assisting in directing movement of the first heat transfer medium. Preferably, the valving is electronically controlled and a programmable controller is utilized for electronically controlling the valving to assist in directing the movement of the first heat transfer medium. As the first heat transfer medium is preferably maintained in the system at a temperature of below 190° F., the piping and equipment that handles that medium can be made of plastic materials of construction. Thus, the entire system operates at temperatures of less than 200° F.

The invention also relates to an apparatus for efficiently generating power or torque which includes a source of pressurized gas; first and second pistons each having a head and a rod; a crankshaft; and a closed chamber having first and second ends for housing the pistons therein. The pistons are journaled to the crankshaft by the rods such that the piston heads face in opposite directions in the chamber towards the first and second ends. The chamber also includes passages for introducing the pressurized gas onto and exhausting spent gas from the chamber, with at least one passage being located at each of the first and second ends of the chamber.

The apparatus advantageously includes control means associated with the passages for opening and closing the passages in a predetermined manner such that the pressurized gas is first introduced into the first end of the chamber and is allowed to become spent by expanding to move the first piston toward the crankshaft for rotating same while the second piston forces spent gas to exit the second end of the chamber, followed by introduction of the pressurized gas into the second end of the chamber and expansion of same to a spent gas to move the second piston toward the crankshaft for further rotating same while the first piston forces spent gas to exit the first end of the chamber, thus generating power or torque due to the rotation of the crankshaft.

In one arrangement, the control means includes one or more electromechanical devices associated with the passages for opening and closing same; and an electronic control unit for coordinating the operation of the electromechanical device so that the passages are opened and closed in the predetermined manner.

In one embodiment of this arrangement, two passages are associated with each end of the chamber, including an entry passage for introducing pressurized gas into the respective end of the chamber and a separate exit passage for allowing the spent gas to exit that end of the chamber. Preferably, each passage includes control means in the form of an electromechanical device that comprises a solenoid, and the control unit operates the solenoids to allow the pressurized gas to enter the first end of the chamber as spent gas is exiting the second end of the chamber. A convenient way to achieve this is to provide the crankshaft with a timing wheel which rotates with the crankshaft, with the timing wheel including a magnet that is operatively associated with sensors that are connected to the control unit to forward to the control unit information relating to the position of the pistons for enabling the control unit to determine when the respective solenoids should be energized for opening or closing of the respective passages.

In another embodiment of this arrangement, one passage is associated with each end of the chamber and is utilized for alternatively introducing pressurized gas into a respective end of the chamber and then allowing spent gas to exit that end of the chamber. Here, the control means is preferably an electromechanical device that comprises a solenoid actuated slide valve member associated with each passage, and the control unit operates the solenoid to actuate the slide valve member to allow the pressurized gas to enter the first end of the chamber as spent gas is exiting the second end of the chamber. This slide valve member preferably comprises a housing having an entry port for receiving pressurized gas, an exit port for exhausting spent gas and a slide member which selectively directs the pressurized gas to one end of the chamber while allowing the spent gas to exit the other end of the chamber through the slide valve member housing. As above, the crankshaft advantageously comprises a timing wheel which rotates with the crankshaft, with the timing wheel including a magnet that is operatively associated with sensors that are connected to the control unit to forward to the control unit information relating to the position of the pistons for enabling the control unit to determine when the solenoid should be energized to actuate the slide valve.

In another arrangement, the control means is a slide valve member which is associated with each passage and is operated to allow the pressurized gas to enter the first end of the chamber as spent gas is exiting the second end of the chamber. The slide valve member preferably includes a valve member movable in a housing and a rod connected thereto. A linkage connecting the crankshaft to the rod of the slide valve member is utilized so that the passages are opened and closed in the predetermined manner.

In yet another arrangement, the control means can be electronically controlled valves which are operated to selectively open and close the passages according to the predetermined manner.

In all these arrangements, the pressurized gas preferably comprises one of the fluorocarbon mixtures described herein. Furthermore, the crankshaft preferably includes high pressure seals to assure that no appreciable amount of gas escapes from the chamber around the crankshaft. To generate power, the crankshaft may be connected to the drive train of a vehicle, or can include windings and brushes for generating electrical energy.

Finally, the invention relates to a vapor engine comprising one of the apparatus described above, and containing n chambers and 2n pistons, wherein n is an integer of between 2 and 6.

DETAILED DESCRIPTION OF THE PREFERRED EMBODIMENTS

Figure 1:
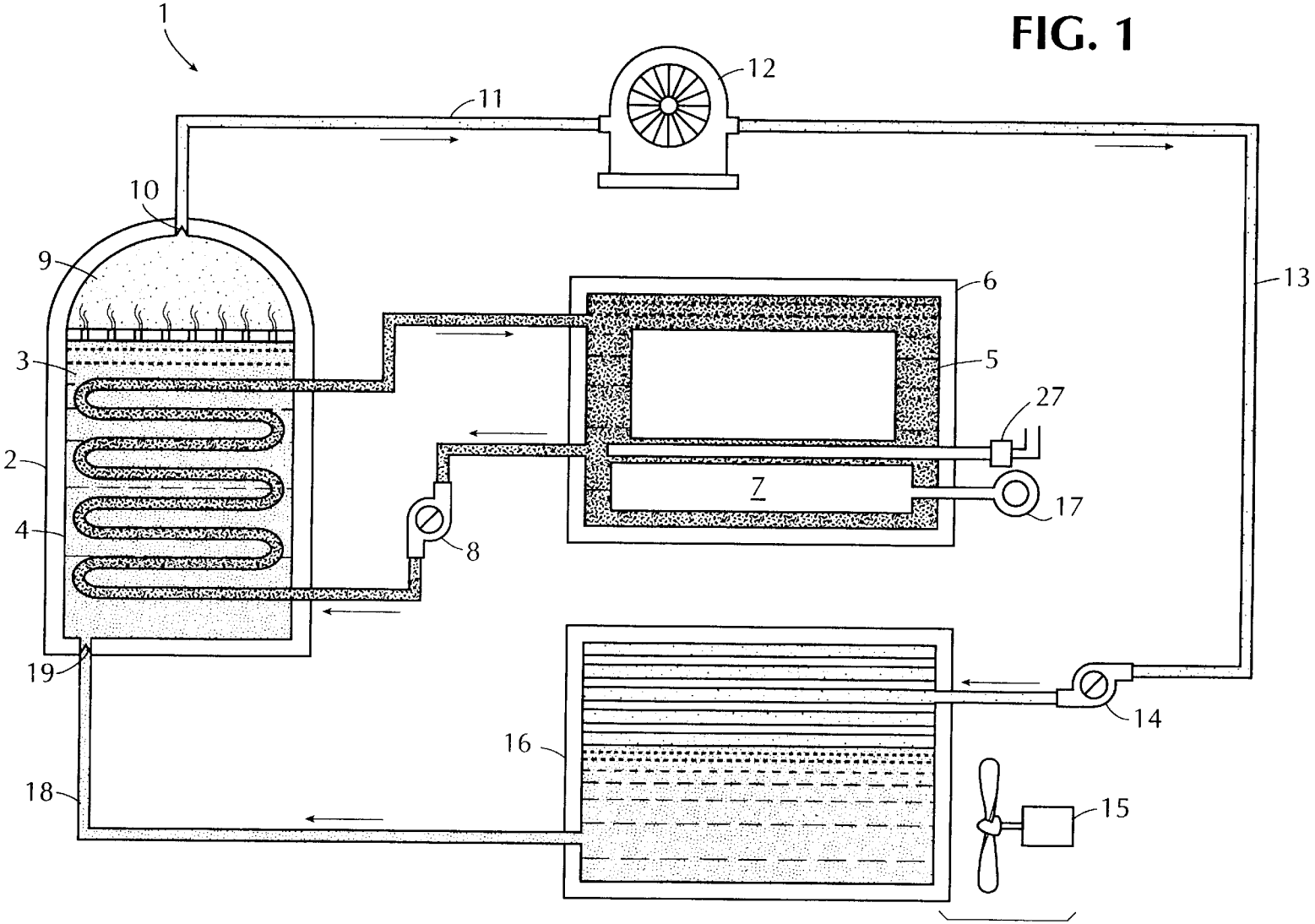
FIG. 1 is a schematic that illustrates the novel closed loop heat transfer circuit of the invention.

The present invention deviates from the known art by utilizing low temperatures and low boiling point heat transfer mediums in a hermetically sealed system to provide novel power sources. The invention operates at temperatures below 200° F. and preferably at a maximum temperature of about 150° F. to avoid combustion of the medium, and to eliminate or significantly reduce the discharge of any gaseous or particulate pollutants. The low temperature also enables low cost, lightweight materials to be used for the equipment that handles the medium, thus enabling lightweight engines or other mechanical force generating devices to be made and used.

Any one of a wide variety of heat transfer mediums can be utilized in this invention. Advantageously, these mediums generate relatively high pressures at temperatures that are well below the boiling point of water, and generally below 190° F. for the specific mediums disclosed herein. These mediums also have boiling temperatures that are significantly below the freezing point of water. Pressures of at least about 400 to as high as about 500 to 700 psi can be provided at a temperature in the range of about 120 to 180° F., with the most preferred mediums having pressure generating temperatures of between about 140 and 160° F. These high pressures are advantageous for efficiently operating turbines or related equipment for generating power or torque.

The most advantageous mediums are fluorocarbons, and while a single fluorocarbon may be used alone, it is preferred to instead use various mixtures and most preferably to utilize azeotropic mixtures. Suitable fluorocarbons for use as mediums include difluoropentafluoroethane, trifluoromethane, pentafluoroethane, tetrafluoroethane, and trifluoroethane. Certain mixtures may contain small amounts of other gases such as hydrocarbons or halogenated hydrocarbons provided that the overall properties of the mixture meet the above-stated property requirements.

The most preferred fluorocarbons and fluorocarbon mixtures include HFC-125, Blends 404A, 407C, and HP-80, Azeotrope 502, and Azeotropic mixtures AZ-20 and AZ-50, all of which are available from Allied Signal Chemicals, Morristown, N.J. AZ-20 is disclosed in U.S. Pat. No. 4,978,467, while AZ-50 is disclosed in U.S. Pat. No. 5,211,867. Other useful fluorocarbon mixtures are disclosed in U.S. Pat. No. 5,403,504. Each of these three patents is expressly incorporated herein by reference to the extent needed to understand these compounds.

The following table illustrates the critical temperature and pressure generation at various temperatures for the most preferred heat transfer mediums.

Table: Temperature and Pressure Relation for Preferred Flourocarbons

TABLE temperature and pressure relation for preferred fluorocarbons

| material | pressure (psi) at temperature | | | |
|---|---|---|---|---|
| (critical temp.) | 120° F. | 130° F. | 140° F. | 150° F. |
| AZ-20 (163° F.) | 417.7 | 475.6 | 538.9 | 608.1 |
| HP-80 (168.3° F.) | 335.6 | 331.5 | 431.5 | 485.8 |
| 125 (151° F.) | 345.3 | 393.1 | 445.4 | 502.4 |
| AZ-50 (160° F.) | 321.9 | 367.8 | 418.7 | 475.3 |
| 404A (162.3° F.) | 309.8 | 353.1 | 400.4 | 452.0 |
| 502 (180° F.) | 282.7 | 320.6 | 362.6 | 408.4 |
| 407C (189.1° F.) | 266.7 | 307.7 | 353.3 | 403.1 |

The most preferred heat transfer medium is known as AZ-20. This medium is an azeotropic fluorocarbon mixture having a boiling point of −62.9° F. This material generates a pressure of over 600 psi when heated to a temperature of 150° F. This heating step requires extremely low energy levels to reach this temperature and maintain it, thus allowing high pressures to be attained with modest heating requirements.

All of the preferred mediums have boiling points which are at least about 14 and generally at least about 20° F. below the freezing point of water. Also, the critical temperatures for these mediums are between 150 and 190° F., and generally around 160 to 170° F. These properties guarantee low temperature operation for generation of operational pressures.

As the amount of energy required to warm the medium to its operating pressure is modest, all that is required is a relatively small heating unit for this purpose. Such a unit can operate on any one of a wide variety of energy sources, including nuclear, electric, solar, natural or hydrocarbon gases, or alternative fossil fuels such as alcohol, vegetable oils or other replenishable materials. The heating unit can directly or indirectly heat the medium. For example, a second heat transfer fluid can be heated by the heating unit, and the heated second medium can be used to heat the first heat transfer medium.

One of ordinary skill in the art will readily recognize that electric power for public and industrial use can be generated from the present system by simply applying heat from various available sources. These sources include thermowells and springs, or even sunlight, supplemented where necessary by sources such as natural or other hydrocarbon gas, other fossil fuels or any of the sources described above, to obtain the relatively low temperature for heating the medium. This in turn reduces the size of power plants to a sufficiently small and compact arrangement so that they can be utilized locally in a town, a building or even in a person's home.

The hermetic sealing of the system avoids the generation of environmental pollutants, cooling systems are not required and the system can be operated at extremely low noise levels. When used, nuclear power plants for heating the medium can be sized at a fraction of their current size due to the low operating temperatures needed for the present system. Also, any waste heat that is generated can be collected and diverted to the source for heating the medium.

Referring to FIG. 1, there is illustrated a vapor engine 1 according to the invention. A vessel 2 contains a liquid heat transfer medium, 3, preferably AZ-20 as noted above, which medium is capable of generating a high pressure when heated to a vapor. For this reason, vessel 2 is provided with a heat exchanger 4. The heat exchanger contains ethylene glycol 5 and is connected to a vessel 6 that contains a supply of that medium. The vessel 6 is heated by a boiler heat exchanger 7 or other suitable heating means to a temperature of about 155° F. As the critical temperature of AZ-20 is 163° F., the operation temperature is maintained below 160° F. The boiler 7 can be heated by any one 17 of a number of sources, including nuclear, combustion of fossil fuel, natural gas or alcohol, electric, solar, or combinations thereof. In addition, the system can include an electric heating element 27 for cold starting capabilities. This can be used alone or in combination with the boiler. Pump 8 circulates glycol 5 between heat exchanger 4 and supply vessel 6.

Heat from glycol 5 in heat exchanger 4 causes the AZ-20 to vaporize and generate a high pressure vapor 9 in the upper part of vessel 2. Check valve 10 assures proper flow of the high pressure vapor 9 through piping 11 and to turbine 12 or other power producing device. If desired, electricity can be generated or the turbine can be operatively associated with wheels or other motion generating devices to product torque or other forces to drive the device. Thereafter, vapor 9 continues through piping 13, urged by pump 14, to condenser 16, where fan 15 cools the gas and returns it to a liquid. This liquid passes through piping 18, and through check valve 19 into vessel 1 for re-use.

As noted above, the invention has utility for automotive and marine transportation, and due to the low temperatures of operation, the materials of construction for the equipment can be engineering thermoplastics such as nylon, polycarbonate, moldite, thermosetting plastics or composites and the like. Also, lightweight metals such as aluminum, titanium or magnesium can be used. This significantly reduces the complexity and weight of the engine that contains the system of the invention. This also simplifies servicing of the engine, with long life and reliable operation being provided. As there is no internal combustion, there is no exhaust and no air pollution generated.

Furthermore, no transmission is needed as the output can be used to directly drive the wheels. The engine has torque and horsepower of larger internal combustion engines due to the relatively high applied pressure of the vapor for the full stroke of the piston. The moving parts of the engine would be permanently lubricated so that no further maintenance is required. Also, no radiator or water system is required.

Electronically controlled valves or valving arrangements facilitate operation of the system, and the heat transfer mediums are non-flammable, so that there is no concern of an engine fire. The return line for the condensed first liquid heat transfer medium can be used for this purpose, as this assists in warming the liquid and generating the vapor. When this system is used as the engine of a vehicle, the relatively cold return line can also be used to cool air for providing air conditioning to the vehicle occupants. The cooling of all electronic devices in the system increases the reliability and life of the components. A master control unit is the heart of the control system and is programmed to perform all functions.

The system is not affected by atmospheric conditions, i.e., barometric pressure, humidity or temperature. The reliability of all components is assured by the hermetics of the system. The complete isolation of the system from atmospheric exposure contributes to the long operational life of the system.

An important feature of this system is the elimination of all internal fuel components, such as injectors, fuel pumps, catalytic converters, fuel rails, and sensors which are costly, troublesome and hazardous but are necessary to the operation of an internal combustion engine.

Today's engines also have become a complexity of mechanical and electronic components, complicated valve trains with 2 to 5 valves per cylinder, ignition systems using 1 to 2 sparkplugs, multiple ignition coils, and the ultimate in the combustion process, fuel systems and fuel injection processes. Added to this is the exhaust system with catalytic converters and specialized mufflers. Both standard gasoline and Diesel engines require most of these components to function. Their efficiency is still low due to the inability to burn fuel completely. This results in incomplete combustion and atmospheric pollution.

Kinetic energy also requires a source of thermal means. Presently fossil fuels and alcohols derived from plants and vegetation are used to accomplish this. The high temperatures of combustion require that the engine materials be made of special alloys and other sophisticated materials. In contrast, the present invention accomplishes its power cycle at a maximum temperature of about 160° F. with a chemical action used to create high pressures which are converted to rotary and linear motion. The low temperatures of 160° F. negates the need for super metals and other materials used in the internal combustion engines. High strength and lightweight plastics can be substituted for metals and alloys.

The elimination of many of the components mentioned above makes this type of motive power simple, safe, economical, durable, and above all, since it has no atmospheric exhaust, is non-polluting and environmentally clean.

Figure 2:
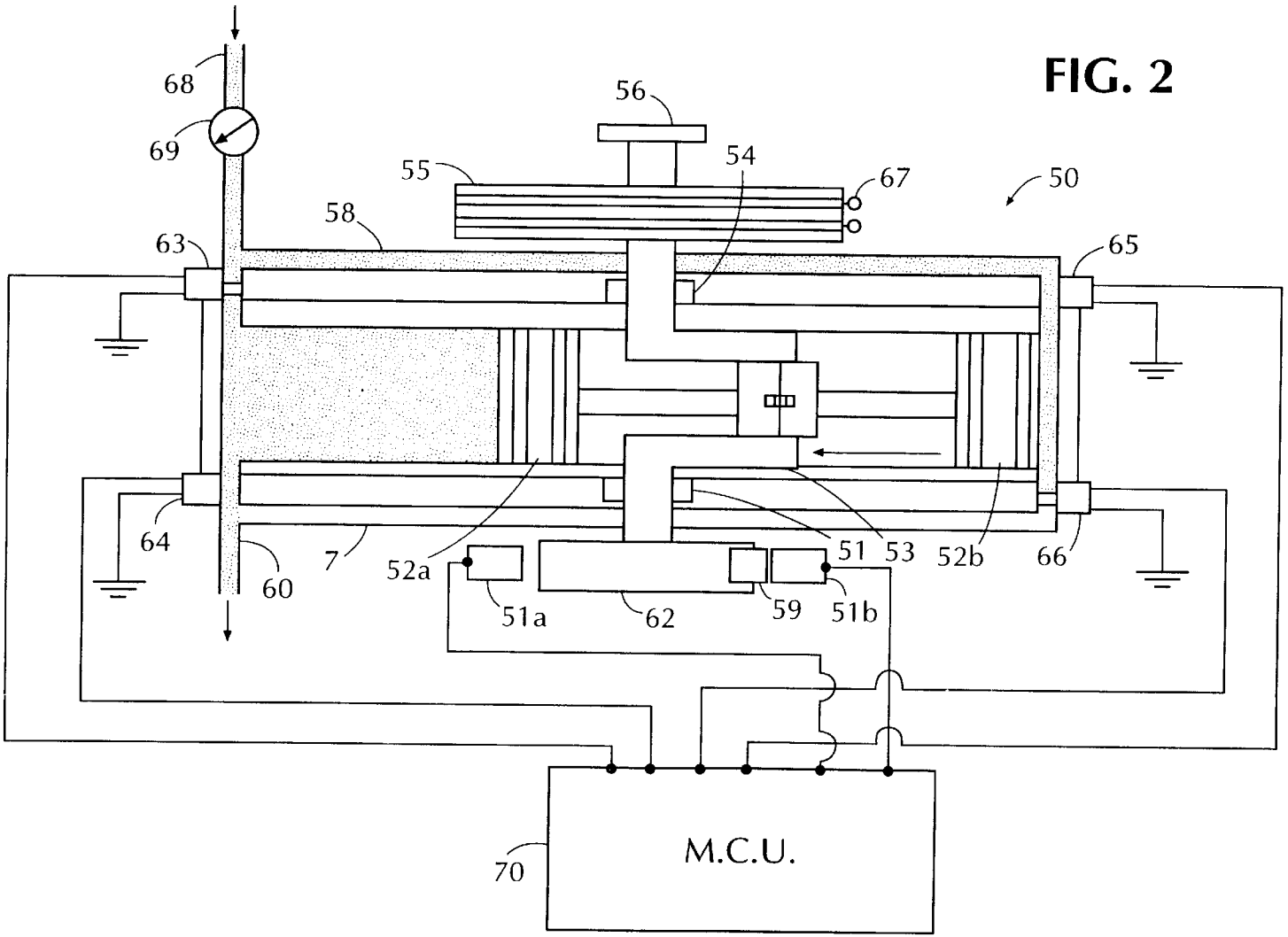
FIGS. 2 and 3 illustrate a two-cylinder vapor engine according to the invention at different points in the cycle of piston stroke.

FIG. 2 shows a two-cylinder configuration vapor engine 50. This engine is devoid of most of the complications of the internal combustion engines. This engine is completely electronic, controlled by the master control unit or MCU 70. This unit is a programmable microprocessor which is utilized to actuate valves, solenoids or other electronic components to open or close various passages to direct pressurized gas into or spent gas from the ends of the chambers behind the piston heads. The only rotating parts of this apparatus are pistons 52A, 52B and crankshaft 53. All electric valves are actuated and programmed through the MCU 70, which receives information from magnetic sensors 51A, 51B, triggered by magnet 59, mounted on timing wheel 62. Solenoids 63, 64, 65, and 66 are energized by the trigger magnet 59 and sensors 61A, 61B according to the programming of the MCU 70.

As can readily be seen, high pressure vapor enters conduit 68 from vessel 2, passes through throttle valve 69 to manifold 58. Solenoids 63 and 66 are de-energized allowing vapor to flow through manifold 58 to right side cylinder 52B to expand into the chamber behind piston 52B to urge it to move towards crankshaft 53 and piston 52A. At the same time, piston 52A moves away from the crankshaft 53 to exhaust spent vapor through manifold 60 to the suction side of the condenser 16 for recycle and re-use. Flywheel 55 contains the electrical windings of a 42-volt alternator, and power is transmitted through contact brushes 67. Attached to crankshaft 53 and flywheel 55 is output flange 56.

Figure 3:
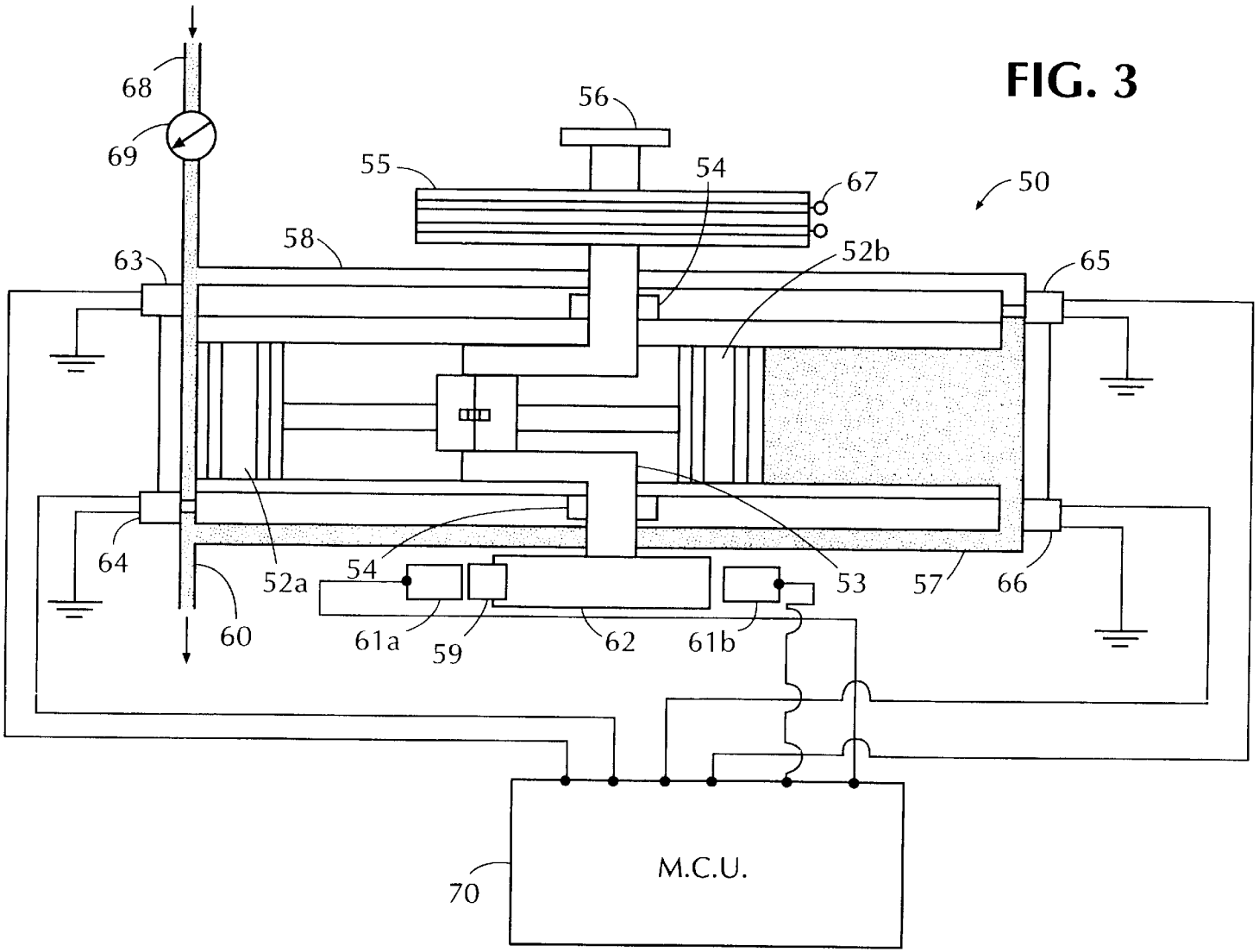

Turning now to FIG. 3, piston 52A has reached the end of the chamber and all exhaust vapors have been vented. The trigger magnet 59 on rotating timing wheel 62 approaches sensor 61A in turn causing the MCU 70 to energize solenoids 65 and 66 and de-energize solenoids 63 and 64 to thus allow entry of pressure into the chamber behind piston 52A. Pressure vapor from conduit 68 flows through throttle 69 into the cylinder chamber behind piston 52A to move it towards crankshaft 53 and piston 52B, forcing spent vapor in the cylinder chamber behind piston 52B to exit through manifold 57 to tube 60 and back to suction side of condenser 16.

Speed, reversing and stopping of engine is accomplished by programming the MCU 70 for desired control and performance. High-pressure seals 54 on crankshaft 53 insure that no vapor is lost. The complete unit can be hermetically sealed from the outside atmosphere, if desired. As one of ordinary skill in the art would readily understand, the engine 50 can be configured in any number of cylinders and any style of block.

Figure 4:
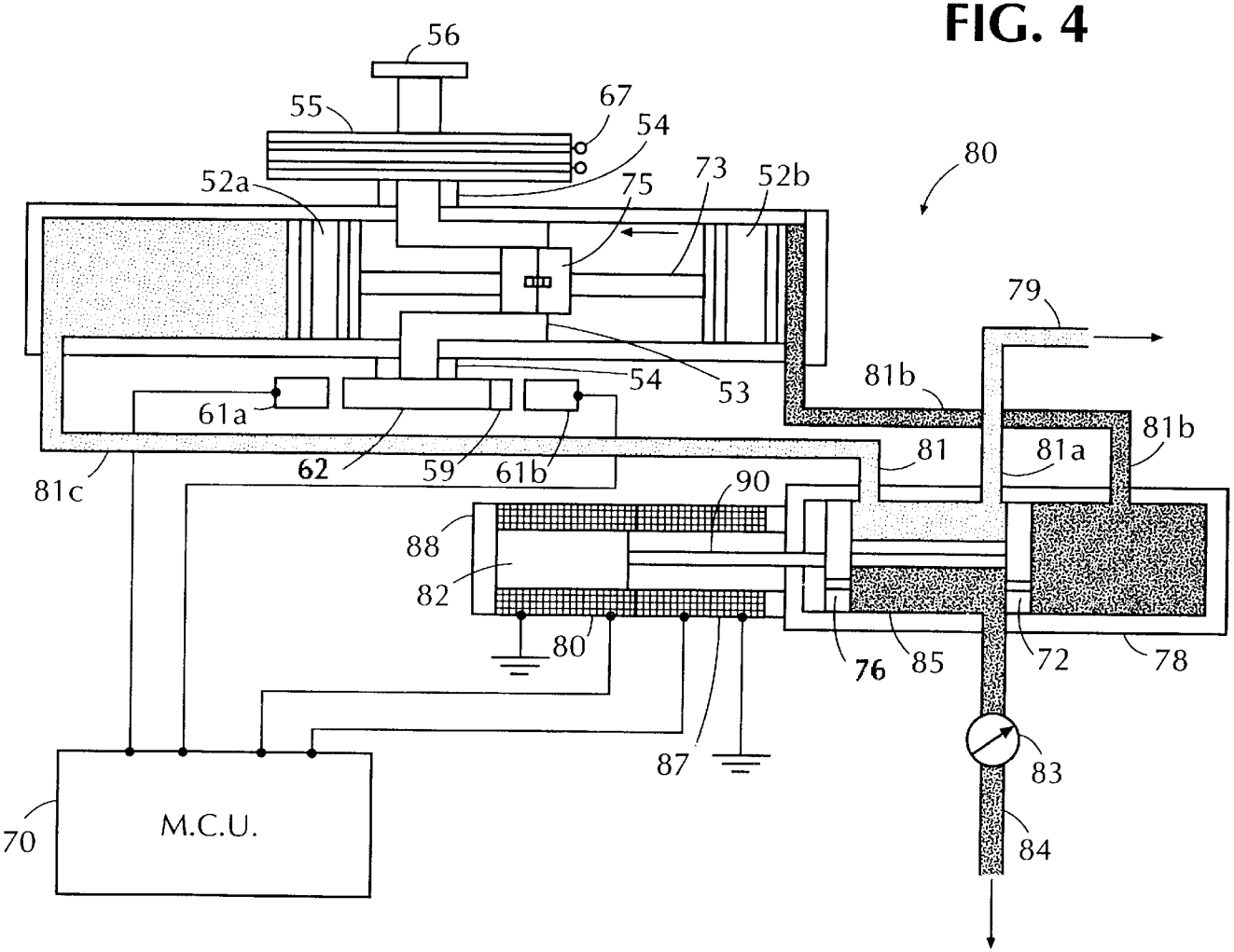
FIG. 4 shows a two-cylinder engine which utilizes a solenoid actuated slide valve.

FIG. 4 shows a similar form of a 2-cylinder engine configuration 80 where like components to those of FIGS. 2 and 3, but using a solenoid actuated slide valve member 78 and solenoid 88. As magnetic impulse is sensed from magnet 59 by sensor 61B as magnet 59 moves along the rotating timing wheel 62, the MCU control 70 energizes coil 80 of solenoid 88 allowing solenoid coil 80 to draw slide valve 85 by rod 90 so that port manifold tube 72 allows vapor from tube 84 to pass through throttle valve 83 to flow through port 72 of slide valve 85. Manifold 81B allows vapor to flow to piston 52B forcing piston to move toward crankshaft 53. Piston 52A is now moving away from crankshaft 53 forcing spent gasses in that cylinder to exit through manifold 81C to port 81 through upper section of slide valve 85, then out through port 81A to return line 79 to condenser 16. As crankshaft 53 reaches dead center, magnet 59 energizes sensor 61A, whereby solenoid core 82 is attracted to solenoid coil 87, to repeat the cycle in the opposite direction. Seals 54 on crankshaft insure that all gas is safely contained within the system. The flywheel 55 contains windings for a 42 volt system and shown are the brushes 67. Flange 56 is for transmission of external power. As with the other design, the entire unit can be encapsulated, if desired.

Figure 5:
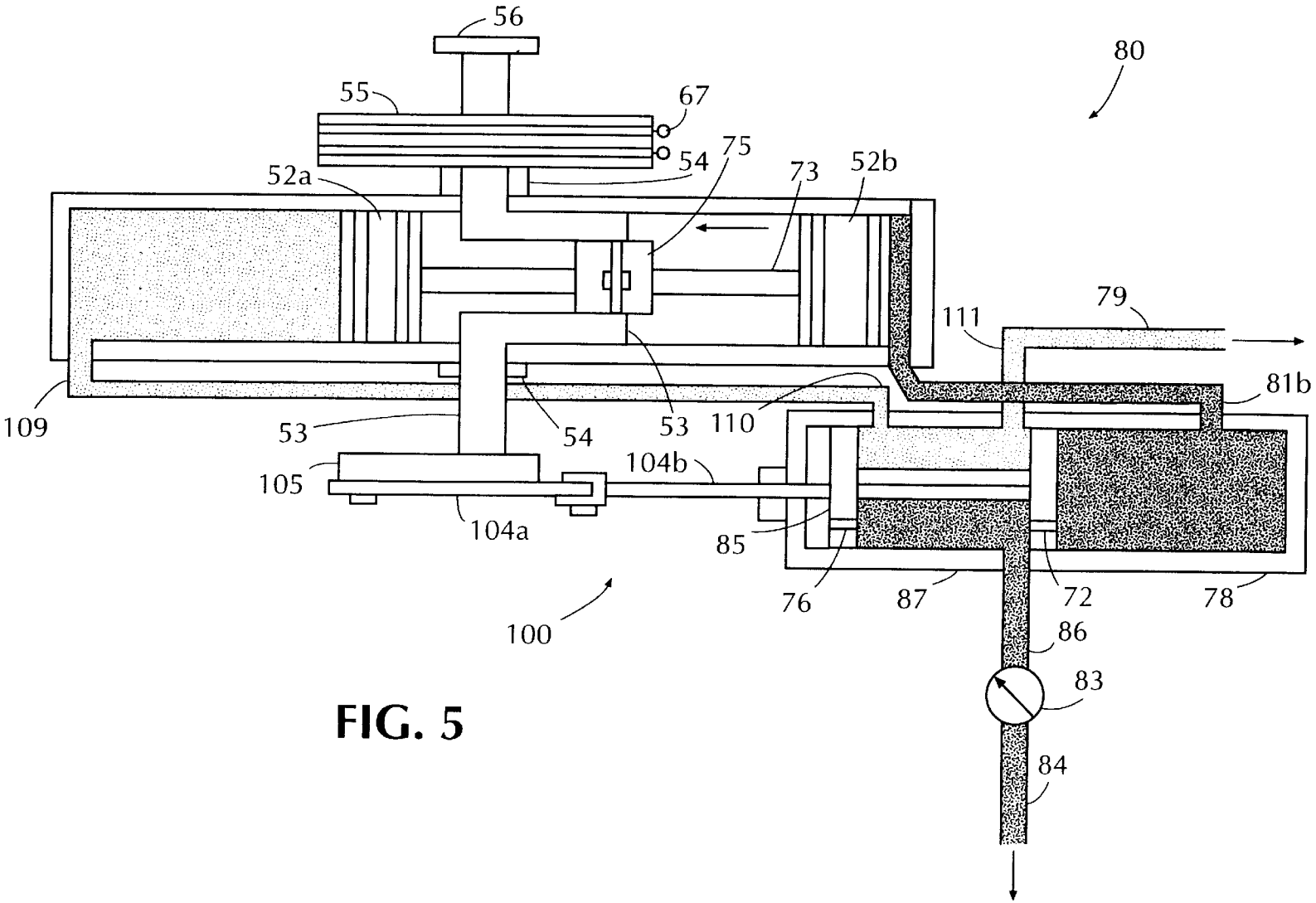
FIG. 5 illustrates the engine of FIG. 4 with a mechanically actuated linkage.

FIG. 5 shows the same engine 80 with a mechanically actuated linkage 100 for slide valve 85. As high pressure gas or vapor passes through throttle valve 83 into manifold 86 slide valve 85 is positioned in housing 87 by the action of cam 105 and linkage 104A and 104B. Vapor passes through slide valve port 109 to piston 52B. Piston 52A is forced to move, thus rotating crank 53 with piston 52A exhausting spent vapor through manifold 109 through slide valve ports 110 and 111 to tube 79 and then to condenser 16. As crankshaft 53 rotates, cam 105 has advanced 180 degrees to activate linkage 104A and 104B to move slide valve 85 to the opposite side of slide valve housing 87. Ports 111 and 109 become the exhaust ports and port 110 becomes the inlet port, due to the position of the slide valve 85. Seals 54 again ensure prevention of leakage of the vapor. Flywheel 55 contains the windings of a 42-volt alternator. The brushes 67 direct current to the electrical system.

Figure 6:
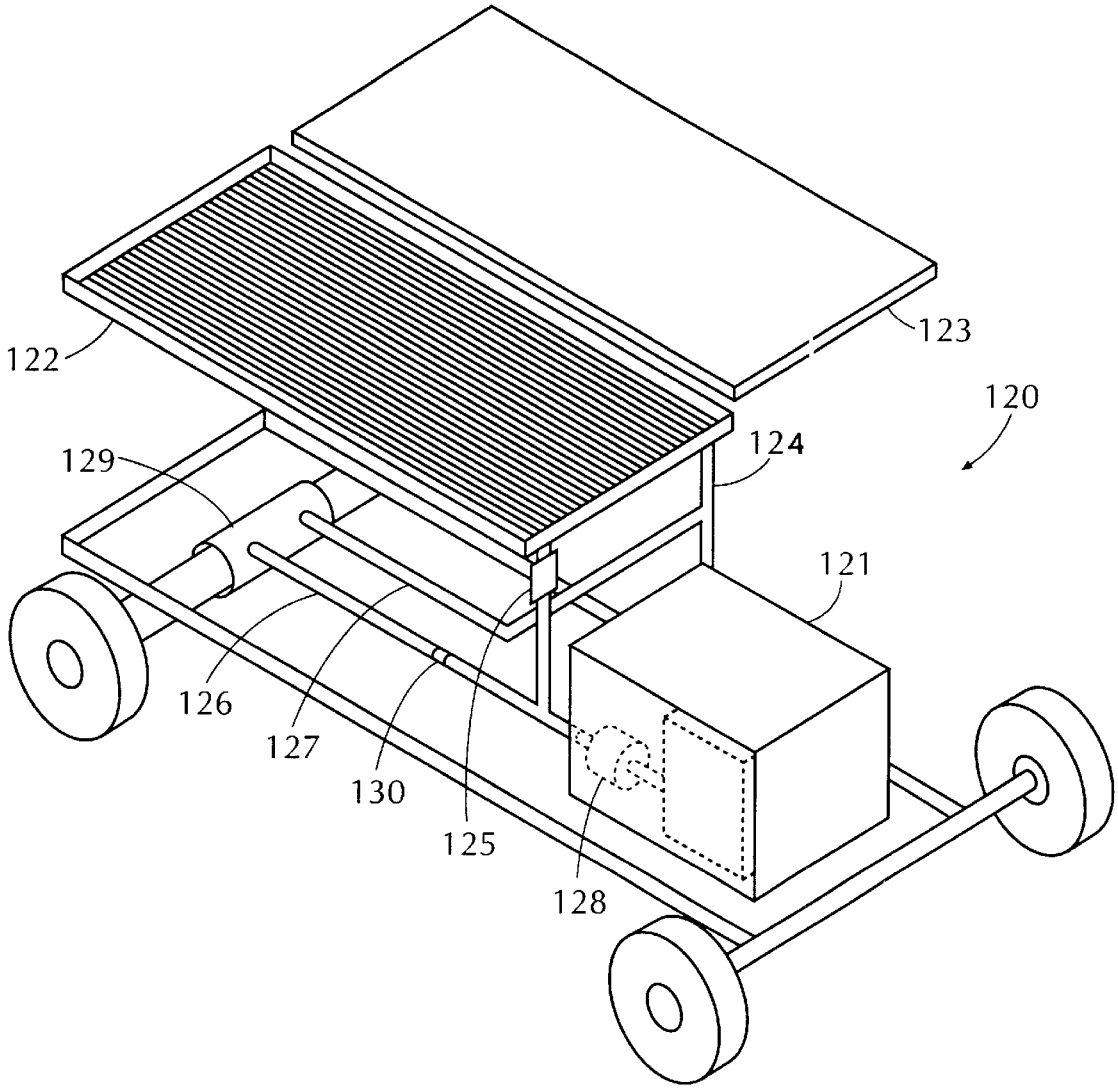
FIG. 6 shows a vehicle which utilizes a solar panel to heat the heat transfer fluid.

FIG. 6 shows a solar powered vehicle 120. The vehicle includes a solar panel 122 connected to the boiler 121 through tube 124 to circulate solar heated ethylene glycol and increased by the boiler heater to 160° F. This in areas of extreme sun increases the thermal efficiency of the unit. The panel is constructed of a grid of hollow copper or aluminum panel through which ethylene glycol is circulated. This solar panel 122 is incorporated in the roof of the vehicle and is protected from the elements by a clear plastic panel 123. Heat can also be absorbed by circulating ethylene glycol through lines 126 and 127 to cool a high efficiency motor which generates a large amount of heat. Pump 128 is the means of returning the fluid to the boiler 121. Thermostat 125 allows only sufficiently heated fluid to circulate. Solenoid valve 130 provides control of fluid from motor 129 or other areas where heat can be derived. These are basic details of a system to which much technology can be directed to attain energy, which is needed by an increasing population demand, and a means of not relying on a diminishing supply of fossil fuels. The use of replenishable fuels, such as alcohols from cane, corn and other vegetable matter can relieve the world problem of atmospheric contamination as we are presently experiencing from fossil fuels.

The vapor engine of the present invention is similar in operation to the steam engine of the early 1900s. Nothing matches the tremendous power and flexibility of those engines, and the present vapor engine can approximate the features of a steam engine. It can rotate in either direction or instantly stop to act as a brake. This eliminates the need for transmissions, resulting in less expensive drive lines for all means of transportation, farm and construction equipment. Power for external use is transmitted via a motor shaft through a housing which is sealed by modern technology, high pressure seals such as those used in automotive air conditioners and refrigeration systems.

The invention also has utility in military applications. Due to the quiet operation, non-exhaust and high power output of the invention, it can be used in tanks, aircraft, ground support vehicles and marine transport vehicles.

EXAMPLE

The following is provided as a comparison of power between an internal combustion engine and a vapor engine according to the invention.

A cylinder with a 4" bore and a 3" stroke has 37.7 cubic inches. The compression ratio is 8.54:1. A combustion force of 5000 pounds translates into 625 pound feet of instantaneous torque.

The same cylinder of the vapor engine of the invention, disregarding the compression ratio with 600 pounds of pressure (0.7854×D2)=(0.7854×16)=12.5664 sq. in.×600 pounds=7,539.84), gives 966 pound feet of continuous torque for the full stroke of the crank. This is an increase of more than 50% compared to the internal combustion engine. Furthermore, in an internal combustion engine, force is gradually depleted as combustion ceases. Also, an internal combustion engine has to proceed through a four cycle process to repeat the power cycle.

The vapor engine of the present invention is double acting in that it develops power with each and every stroke of the piston. This results in a smaller engine with more power and smoother operation. As the intake and exhaust systems are not exposed to the atmosphere, and the system operates at a relatively low temperature of 150° F., the transfer medium can be heated to create the vapor pressure using any one of a variety of non-polluting sources. The AZ-20 medium, which generates over 600 psi at 150° F., can be recycled and re-used many times over, resulting is low operation costs and maintenance. The engine can be configured as a piston engine of any reasonable number of cylinders depending upon desired horsepower, or as a turbine or vane type motor. The system can also be used to activate mechanisms requiring high pressure and low temperatures.

Having described the invention in detail herein and with reference to the referred embodiments thereof, it will be apparent that various modifications and variations are possible without departing from the true spirit and scope of the invention. For example, one of ordinary skill in the art can formulate various fluorocarbon heat transfer medium mixtures that will meet and even exceed the operational criteria set forth herein. Also, other electronically controlled valves or other pressure regulating devices can be used to direct the high pressure gas into the apparatus chamber behind the piston heads. In addition, the MCU can be a microprocessor or a miniature computer. Thus, it is specifically intended that all such modifications and variations be covered by appended claims.

What is claimed is:

1. An apparatus for efficiently generating power or torque which comprises:

a source of pressurized gas;

first and second pistons each having a head and a rod;

a crankshaft;

a closed chamber having first and second ends for housing the pistons therein, the pistons being journaled to the crankshaft by the rods such that the piston heads face in opposite directions in the chamber towards the first and second ends;

passages for introducing the pressurized gas onto and exhausting spent gas from the chamber, with at least one passage being located at each of the first and second ends of the chamber; and control means associated with the passages for opening and closing the passages in a predetermined manner such that the pressurized gas is first introduced into the first end of the chamber and is allowed to become spent by expanding to move the first piston toward the crankshaft for rotating same while the second piston forces spent gas to exit the second end of the chamber, followed by introduction of the pressurized gas into the second end of the chamber and expansion of same to a spent gas to move the second piston toward the crankshaft for further rotating same while the first piston forces spent gas to exit the first end of the chamber, thus generating power or torque due to the rotation of the crankshaft;

wherein the pressurized gas comprises a fluorocarbon mixture that (a) generates a high pressure of at least 500 psi at a pressure generation temperature that is below 190 F., (b) has a boiling point which is at least 10 F. below the freezing point of water, and (c) has a critical temperature which is above 160 F. so that the apparatus can operate at a temperature of less than 200 F.

2. The apparatus of claim 1 wherein the control means comprises one or more electromechanical devices associated with the passages for opening and closing same; and an electronic control unit for coordinating the operation of the electromechanical device so that the passages are opened and closed in the predetermined manner.

3. The apparatus of claim 2, wherein the electromechanical devices include electronically controlled valves which are operated to selectively open and close the passages.

4. The apparatus of claim 2, wherein two passages are associated with each end of the chamber, including an entry passage for introducing pressurized gas into the respective end of the chamber and a separate exit passage for allowing the spent gas to exit that end of the chamber.

5. The apparatus of claim 4 wherein each passage includes an electromechanical device, each electromechanical device comprises a solenoid, and the control unit operates the solenoids to allow the pressurized gas to enter the first end of the chamber as spent gas is exiting the second end of the chamber.

6. The apparatus of claim 5, wherein the crankshaft comprises a timing wheel which rotates with the crankshaft, with the timing wheel including a magnet that is operatively associated with sensors that are connected to the control unit to forward to the control unit information relating to the position of the pistons for enabling the control unit to determine when the respective solenoids should be energized for opening or closing of the respective passages.

7. The apparatus of claim 2, wherein one passage is associated with each end of the chamber and is utilized for alternatively introducing pressurized gas into a respective end of the chamber and then allowing spent gas to exit that end of the chamber.

8. An apparatus for efficiently generating power or torque which comprises:

a source of pressurized gas;

first and second pistons each having a head and a rod;

a crankshaft;

a closed chamber having first and second ends for housing the pistons therein, the pistons being journaled to the crankshaft by the rods such that the piston heads face in opposite directions in the chamber towards the first and second ends;

passages for introducing the pressurized gas onto and exhausting spent gas from the chamber, with at least one passage being located at each of the first and second ends of the chamber; and control means associated with the passages for opening and closing the passages in a predetermined manner such that the pressurized gas is first introduced into the first end of the chamber and is allowed to become spent by expanding to move the first piston toward the crankshaft for rotating same while the second piston forces spent gas to exit the second end of the chamber, followed by introduction of the pressurized gas into the second end of the chamber and expansion of same to a spent gas to move the second piston toward the crankshaft for further rotating same while the first piston forces spent gas to exit the first end of the chamber, thus generating power or torque due to the rotation of the crankshaft;

wherein the control means comprises one or more electromechanical devices associated with the passages for opening and closing same; and an electronic control unit for coordinating the operation of the electromechanical device so that the passages are opened and closed in the predetermined manner, wherein one passage is associated with each end of the chamber and is utilized for alternatively introducing pressurized gas into a respective end of the chamber and then allowing spent gas to exit that end of the chamber, wherein the electromechanical device comprises a solenoid actuated slide valve member, each passage is associated with the slide valve member, and the control unit operates the solenoid to actuate the slide valve member to allow the pressurized gas to enter the first end of the chamber as spent gas is exiting the second end of the chamber.

9. The apparatus of claim 8 wherein the slide valve member comprises a housing having an entry port for receiving pressurized gas, an exit port for exhausting spent gas and a slide member which selectively directs the pressurized gas to one end of the chamber while allowing the spent gas to exit the other end of the chamber through the slide valve member housing.

10. The apparatus of claim 9, wherein the crankshaft comprises a timing wheel which rotates with the crankshaft, with the timing wheel including a magnet that is operatively associated with sensors that are connected to the control unit to forward to the control unit information relating to the position of the pistons for enabling the control unit to determine when the solenoid should be energized to actuate the slide valve.

11. An apparatus for efficiently generating power or torque which comprises:

a source of pressurized gas;

first and second pistons each having a head and a rod;

a crankshaft;

a closed chamber having first and second ends for housing the pistons therein, the pistons being journaled to the crankshaft by the rods such that the piston heads face in opposite directions in the chamber towards the first and second ends;

passages for introducing the pressurized gas onto and exhausting spent gas from the chamber, with at least one passage being located at each of the first and second ends of the chamber; and control means associated with the passages for opening and closing the passages in a predetermined manner such that the pressurized gas is first introduced into the first end of the chamber and is allowed to become spent by expanding to move the first piston toward the crankshaft for rotating same while the second piston forces spent gas to exit the second end of the chamber, followed by introduction of the pressurized gas into the second end of the chamber and expansion of same to a spent gas to move the second piston toward the crankshaft for further rotating same while the first piston forces spent gas to exit the first end of the chamber, thus generating power or torque due to the rotation of the crankshaft;

wherein the control means comprises a slide valve member which is associated with each passage, the member including a valve member movable in a housing and a rod connected thereto; and a linkage connecting the crankshaft to the rod of the slide valve member so that the passages are opened and closed in the predetermined manner.

12. The apparatus of claim 1, wherein the crankshaft includes high pressure seals to assure that no appreciable amount of gas escapes from the chamber around the crankshaft.

13. The apparatus of claim 1, wherein the crankshaft is connected to the drive train of a vehicle or includes windings and brushes for generating electrical energy.

14. A vapor engine comprising the apparatus of claim 1 and containing n chambers and 2n pistons, wherein n is an integer of between 1 and 6.

15. A vapor engine comprising the apparatus of claim 2 and containing n chambers and 2n pistons, wherein n is an integer of between 1 and 6.

16. A vapor engine comprising the apparatus of claim 11 and containing n chambers and 2n pistons, wherein n is an integer of between 1 and 6.

17. The apparatus of claim 8, wherein the pressurized gas comprises a fluorocarbon mixture that (a) generates a high pressure of at least 500 psi at a pressure generation temperature that is below 190 F., (b) has a boiling point which is at least 10 F. below the freezing point of water, and (c) has a critical temperature which is above 160 F. so that the apparatus can operate at a temperature of less than 200 F.

18. The apparatus of claim 11, wherein the pressurized gas comprises a fluorocarbon mixture that (a) generates a high pressure of at least 500 psi at a pressure generation temperature that is below 190 F., (b) has a boiling point which is at least 10 F. below the freezing point of water, and (c) has a critical temperature which is above 160 F. so that the apparatus can operate at a temperature of less than 200 F.

* * * * *